United States Patent [19]

Iacovangelo

[11] Patent Number: 4,979,988

[45] Date of Patent: Dec. 25, 1990

[54] AUTOCATALYTIC ELECTROLESS GOLD PLATING COMPOSITION

[75] Inventor: Charles D. Iacovangelo, Schenectady, N.Y.

[73] Assignee: General Electric Company, Schenectady, N.Y.

[21] Appl. No.: 444,344

[22] Filed: Dec. 1, 1989

[51] Int. Cl.[5] ..... C23C 18/00

[52] U.S. Cl. ..... 106/1.26; 106/1.18; 427/304

[58] Field of Search ..... 106/1.26, 1.18; 427/304

[56] References Cited

U.S. PATENT DOCUMENTS

| | | | |
|---|---|---|---|
| 3,700,469 | 10/1972 | Okinaka | 427/443.1 |
| 3,917,885 | 11/1975 | Baker | 427/304 |
| 4,092,154 | 4/1978 | Dietz, Jr. et al. | 75/109 |
| 4,337,091 | 6/1982 | El-Shazly et al. | 106/1.23 |
| 4,792,469 | 12/1988 | Saito | 106/1.26 |
| 4,863,766 | 5/1989 | Iacovangelo et al. | 427/443.1 |

FOREIGN PATENT DOCUMENTS

| | | | |
|---|---|---|---|
| 16409 | 10/1962 | Japan | 106/1.26 |
| 2121444A | 6/1983 | United Kingdom | |

OTHER PUBLICATIONS

Application Ser. No. 431,360 to Iacovangelo, filed Nov. 3, 1989.

Application Ser. No. 431,358 to Iacovangelo, filed Nov. 3, 1989.

Matsuoka et al., Heavy Disposition of Electroless Gold, Plating and Surface Finishing, May 1988, pp. 102–106.

Ganu and Mahapatra, Electroless Gold Deposition for Electronic Industry, Journal of Scientific & Industrial Research, vol. 46; 4–1987, pp. 154–161.

Ali & Christie, A Review of Electroless Gold Deposition Processes, Gold Bull., 1984, 17(4), pp. 118–127.

Okinaka et al., Some Practical Aspects of Electroless Gold Plating, Journal of ElectroChem. Soc., 1–1974, pp. 56–62.

Pourbaix, M., Atlas of Electrochemical Equilibria in Aqueous Solutions, First English Ed., 1966, Pergamon Press, Section 5.2, pp. 168–176.

*Primary Examiner*—Karl Group

*Attorney, Agent, or Firm*—Sudhir Deshmukh; James C. Davis, Jr.; William H. Pittman

[57] ABSTRACT

An aqueous autocatalytic electroless gold plating composition having improved stability and which can plate gold directly onto gold or on nickel at an excellent rate is provided, the composition having a pH within the range of about 10 to about 14 and comprising about 0.002 to about 0.02M of a water-soluble alkali metal monovalent gold cyanide complex, about 0.01 to about 0.1M of a water-soluble alkali metal cyanide, about 0.1 to about 1.0M of a carbonate compound, about 0.01 to about 0.1M of a first reducing agent selected from the group consisting of water soluble alkali metal borohydrides and water soluble amine boranes, and about 0.01 to about 1.0M of a second reducing agent selected from the group consisting of hydrazine and hydrazine derivatives.

19 Claims, 2 Drawing Sheets

AUTOCATALYTIC ELECTROLESS GOLD PLATING COMPOSITION

BACKGROUND OF THE INVENTION

The present invention relates to electroless gold plating compositions. More particularly, the present invention is directed to autocatalytic gold plating compositions useful for plating gold on gold and on nickel.

Electroless plating is useful in applications requiring coatings for complex shapes This capacity makes electroless plating techniques particularly useful in the electronics industry, for example, in the metallization of conductors and insulators in printed circuit boards. Base metals such as nickel and copper are often used in electroless plating processes to metallize conductors and insulators However, because of its low contact resistance and beneficial effects on bonding leads, electroless gold plating is continually desired for coating complex shapes and electrically isolated tracks and bonding pads in printed circuit boards.

It has been found, however, that the stability and plating rate of a particular electroless plating bath is critically affected by the substrate being plated. Plating baths presently used to plate gold onto gold are virtually incapable of plating gold onto nickel and baths used for plating gold onto nickel are extremely unsuitable for plating gold onto gold.

For example, U.S. Pat. No. 4,863,766 to Iacovangelo et al. discloses an electroless plating bath for plating gold onto nickel wherein the bath contains potassium gold cyanide, a water-soluble alkali metal cyanide as a complexing agent, and hydrazine as the reducing agent. The Iacovangelo bath is stable and provides high plating rates while plating gold onto nickel, but plating continues therein only as long as the nickel substrate remains in contact with the plating bath. Plating essentially stops once the nickel substrate is covered with the gold. The oxidation of the reducing agent used in the Iacovangelo bath, hydrazine, is very poorly catalyzed by gold. Furthermore, cyanide, which is used to stabilize the gold complex, i.e., the potassium gold cyanide, is a poison for hydrazine oxidation. The already poor catalytic activity of gold for hydrazine oxidation becomes nil with only trace amounts of cyanide. Because hydrazine is not oxidized on gold in the presence of cyanide, the Iacovangelo bath is not autocatalytic, i.e., it will not plate gold onto gold. Thus, at the present time, separate plating baths are used when it is desired to plate gold onto nickel and then onto the gold deposited on the nickel.

As indicated above, the term "autocatalytic" is used herein to describe a plating system which is capable of depositing gold on a gold substrate. Autocatalytic gold plating is advantageous, for example, for increasing the thickness of existing gold surfaces which are too thin for some uses. Autocatalytic electroless gold plating compositions are known in the art. Reference may be made, for example, to U.S. Pat. Nos. 3,700,469; 3,917,885; and 4,337,091.

U.S. Pat. No. 3,700,469 to Okinaka discloses an autocatalytic electroless gold plating bath containing a soluble gold cyanide complex ion, excess free cyanide to stabilize the gold cyanide complex ion, an alkaline agent as a pH adjustor, and an alkali metal borohydride or dimethylamine borane as a reducing agent. Although a truly autocatalytic plating bath, the Okinaka bath has been found to be extremely sensitive to nickel ions in solution. The use of the Okinaka bath to plate gold directly onto nickel results in a buildup of nickel in the bath to the point wherein the bath shuts down. In addition to nickel sensitivity, the Okinaka formulation also suffers from several limitations which reduce its usefulness for plating gold onto gold. These limitations include instability, low plating rate (about 1 micrometer per hour), plating rate deterioration, and difficulty of bath replenishment.

U.S. Pat. No. 3,917,885 to Baker discloses an autocatalytic electroless plating bath wherein the source of gold is an alkali metal imide complex of the gold rather than an alkali metal gold cyanide. However, the Baker bath, like the Okinaka bath, has been found to be extremely sensitive to the presence of nickel, which results in the shutdown of the plating bath. The Baker bath also shares the other limitations of the Okinaka bath, particularly deteriorating plating rate.

U.S. Pat. No. 4,337,091 to El-Shazly et al. discloses the use of trivalent gold metal complexes as the source of gold in an electroless gold plating bath, the reducing agent being any of the borohydrides, cyanoborohydrides or amine boranes that are soluble and stable in aqueous solution. A later version of the El-Shazly bath, disclosed in U.K. Patent Application No. G.B. Z1Z1444A, uses a mixture of trivalent and monovalent water-soluble gold cyanide complexes. The El-Shazly baths also suffer from high sensitivity to nickel ions and the other limitations found in the Okinaka and Baker baths.

Autocatalytic electroless plating baths having improved stability, higher plating rates, ease of bath replenishment, and decreased sensitivity to nickel ions were achieved in commonly assigned and copending application serial nos. (07/431,360, filed on Nov. 3, 1989, and 07/431,358, filed on Nov. 3, 1989, both to Iacovangelo. The baths described in these references contain a water-soluble alkali metal monovalent gold cyanide complex, a water-soluble cyanide compound as a complexing agent for the gold complex, a carbonate compound, and a reducing agent selected from the group consisting of water soluble alkali metal borohydrides and water-soluble amine boranes, the pH of the plating composition being in the range of about 10 to about 14. The bath described in application Ser. No. 07/431,358, filed on Nov. 3, 1989, referred to above, further contains an aliphatic amine to improve the bath's throwing power, i.e., the ability of the bath to provide a uniform deposit on the entire surface of a substrate. Although the baths described in the Iacovangelo applications have improved stability, increased plating rate, and lower sensitivity to nickel ions, and are extremely effective in plating gold onto gold, there is room for improvement in the ability of these baths to plate gold onto nickel.

As noted previously herein, separate baths are currently required when it is desired to plate gold first on a nickel substrate and then on the gold deposited on the nickel substrate. It would be desirable to provide a single electroless plating bath which is capable of effectively plating both gold and nickel substrates.

SUMMARY OF THE INVENTION

The present invention provides an aqueous autocatalytic electroless gold plating composition having a pH within the range of about 10 to about 14 and comprising about 0.002 to about 0.20 moles per liter (M) of a water-soluble alkali metal monovalent gold cyanide complex, about 0.01 to about 0.1M of a water-soluble alkali metal cyanide, about 0.1 to about 1.0M of a carbonate compound, about 0.01 to about 0.1M of a first reducing agent selected from the group consisting of water soluble alkali metal borohydrides and water soluble amine boranes, and about 0.01 to about 1.0M of a second reducing agent selected from the group consisting of hydrazine and hydrazine derivatives.

The use of the two reducing agents in the plating bath of this invention allows gold to be electrolessly plated directly onto either gold or nickel at an excellent rate, i.e., up to about 7 micrometers per hour, with no deterioration in plating rate or seeding of gold in the bath for a relatively long period of time.

DETAILED DESCRIPTION OF THE INVENTION

Figure 1:
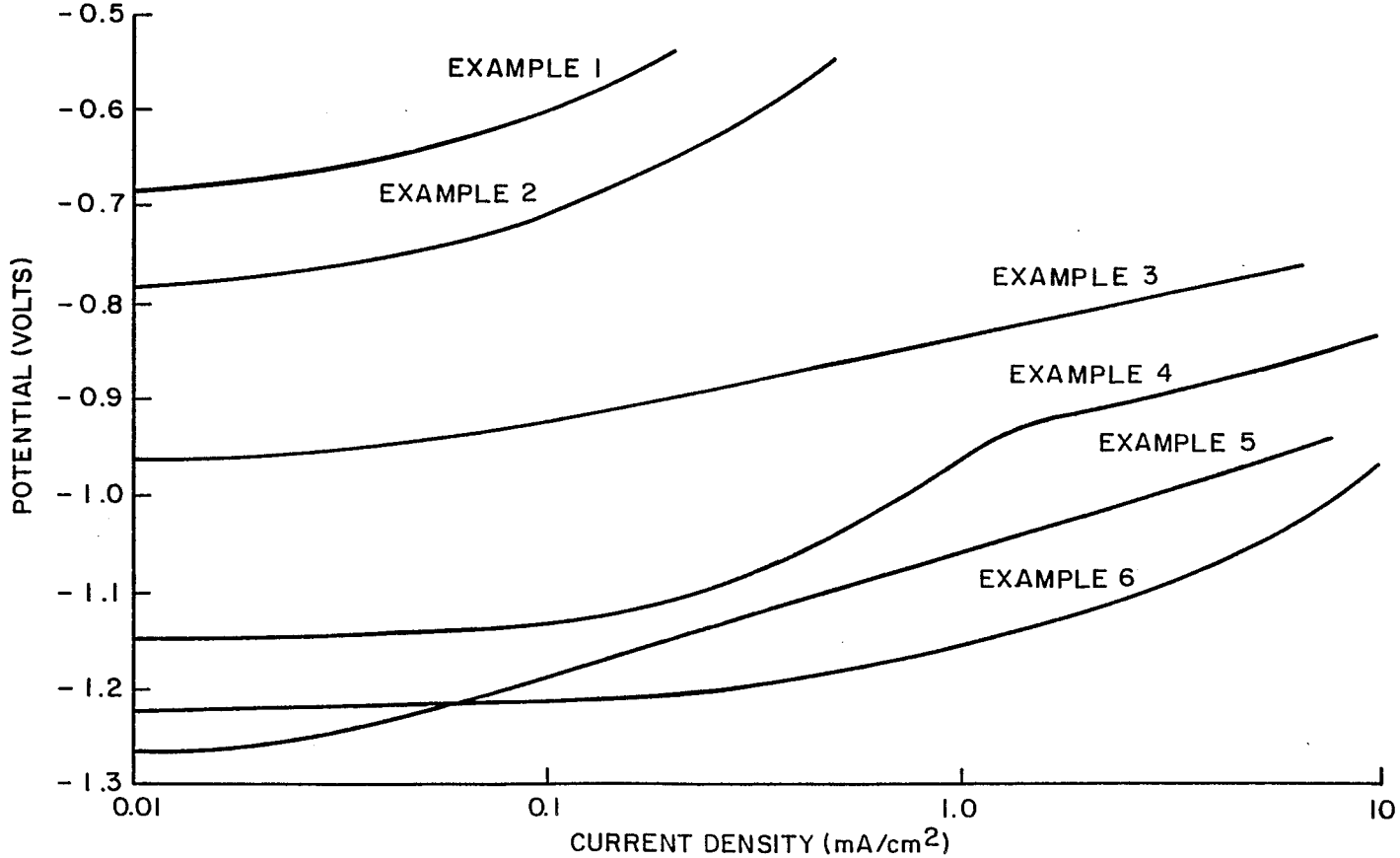
FIG. 1 is a schematic representation of the oxidation kinetics of the reducing agents dimethylamine borane and hydrazine on gold, nickel, and copper substrates at 80° C. in a solution of 0.800M KOH.

The present invention is based on two discoveries. The first is that different reducing agents behave differently on a given substrate. Because the initial stage of plating requires that the substrate be a catalyst for oxidation of the reducing agent, it is impossible to make blanket statements that a bath will plate on a long list of substrates without actually testing them. Once a substrate has been plated with a small amount of gold, either the substrate or the gold may be the catalyst.

The present invention is also based on the discovery that poisons, such as cyanide and lead, will vary in how strongly they poison any given reaction according to the reaction involved and the substrate for that reaction. Thus, poisons will more effectively inhibit oxidation of a reducing agent on certain substrates than on other substrates.

Although the patents discussed above all claim that the baths disclosed therein will plate onto a wide list of metals, almost all examples provided in those references are on copper substrates rather than on gold and almost no examples are on nickel This is because copper is an outstanding catalyst for most of the commonly used reducing agents even in the presence of cyanide. In comparison, as will be shown in the examples below, in the presence of cyanide, nickel is not a good catalyst for a boron-based reducing agent, e.g., dimethylamine borane, which is used in most autocatalytic plating baths. Therefore, despite assertions to the contrary in the patents discussed above, it has been found that baths containing a boron-based compound as the sole reducing agent are extremely limited in their capacity to plate gold onto nickel in the presence of cyanide.

The key to the present invention is the use of a second reducing agent active on materials on which the first reducing agent is not.

The reducing agents are used in the bath of this invention to supply electrons to the oxidation-reduction reaction. Suitable reducing agents include any of the borohydrides or amine boranes which are soluble and stable in aqueous solution. Thus, alkali metal borohydrides, preferably sodium and potassium borohydrides, may be used. Various substituted borohydrides, such as sodium or potassium trimethoxyborohydride, may also be used. The preferred reducing agents for use in the present invention are the amine boranes such as mono- and di- lower alkyl, e.g., up to $C_6$ alkyl-amine boranes, preferably isopropyl amine borane and dimethylamine borane. For purposes of the present invention, dimethylamine borane is preferred.

During electroless plating of gold on a metal substrate, oxidation/reduction reactions begin simultaneously when the substrate is immersed in the plating bath. These reactions occur at the surface of the metal or metallized substrate. At the substrate, the gold ions accept electrons from the reducing agent and deposit a gold film on the substrate. Initially, the reducing agent reacts on the substrate, giving electrons to the metal ions and being converted to its oxidized form. If the plating bath is autocatalytic, the gold film will then catalyze the reaction and cause it to continue If the bath is not autocatalytic, plating will stop once the substrate is covered with gold film.

Cyanide is a strong poison for the oxidation of the reducing agent. However, cyanide is necessary to prevent the spontaneous decomposition of the bath by reaction [1]below:

$$(CH_3)_2NHBH_3+4OH^-+3Au(CN)_2^-=1$$
$$(CH_3)_2NH+BO_2+1.5H_2+2H_2O+3Au+6CN^- \quad 1$$

The two reducing agents used in the bath of the present invention are (1) a water-soluble alkali metal borohydride or amine borane (sometimes referred to herein as the first reducing agent) and (2) hydrazine or derivative thereof (sometimes referred to herein as the second reducing agent).

The combination of these two reducing agents allows the bath of this invention to be autocatalytic and to plate gold directly onto nickel. In the early stages of plating, hydrazine (or a hydrazine derivative) is used to plate gold onto nickel. Once a little gold is plated, both the hydrazine and the boron-based reducing agent are active, the boron-based reducing agent being active on the gold and the hydrazine being active on the nickel which is still exposed. When the nickel is completely covered with gold, only the boron-based reducing agent is active and the bath continues only as a truly autocatalytic bath.

Suitable alkali metal borohydrides and amine boranes include any of the borohydrides or amine boranes which are soluble and stable in aqueous solution The preferred alkali metal borohydrides are sodium and potassium borohydride, with potassium borohydride being most preferred. Various substituted borohydrides, such as sodium or potassium trimethoxyborohydride may also be used.

In the present invention, amine boranes are preferred to the borohydrides as the first reducing agent. Suitable amine boranes include mono- and di- lower alkyl, e.g., up to about six carbon atoms, amine boranes, preferably, isopropyl amine borane and dimethylamine borane, with dimethylamine borane being most preferred.

The second reducing agent used in the bath of the present invention is hydrazine or a derivative thereof. Examples of suitable hydrazine derivatives include hydroxyethylhydrazine, hydrazine sulfate, hydrazine dihydrochloride, and hydrazine hydrate. The preferred hydrazine derivative is hydrazine hydrate.

The amount of the boron-based reducing agent, i.e., alkali metal borohydride or amine borane, present in the bath of this invention is generally about 0.01 to about 0.1, preferably about 0.04 to 0.08, and most preferably about 0.045 to about 0.055, M.

The amount of hydrazine or hydrazine derivative present in the bath is typically about 0.01 to about 1.0, preferably about 0.2 to 0.5, and most preferably about 0.25 to about 0.35, M.

Carbonate is added to the plating bath of this invention to accelerate the oxidation kinetics of the reducing agent on the substrate and material being deposited, i.e., gold, without reducing the amount of complexing agent or other poisons present to maintain bath stability The carbonate is typically added to the plating bath in the form of an alkali metal carbonate such as, for example, sodium or potassium carbonate, with potassium carbonate being preferred. The carbonate compound should be added to the bath in an amount ranging from about 0.1 to about 1.0, preferably about 0.6 to about 0.8, and most preferably about 0.750 to about 0.800, M.

The gold is contained in the plating bath of this invention in the form of the complex ion $Au(CN)_2^-$. It is introduced in the bath as a water-soluble alkali metal gold cyanide complex, such as, for example, potassium gold cyanide, sodium gold cyanide or lithium gold cyanide, preferably as potassium gold cyanide. The concentration of the gold cyanide complex ranges from a minimum concentration which yields reasonable plating rates to a concentration above which no improvement in bath characteristics is obtained. Typically, this concentration is in the range of about 0.002 to about 0.20, preferably about 0.005 to about 0.0075, and most preferably about 0.005 to about 0.006, M.

It is essential that the electroless plating bath of this invention contain free cyanide ions in order to stabilize the gold cyanide complex. Free cyanide increases the stability of the bath and prevents spontaneous liberation of metallic gold in the presence of the reducing agent. The free cyanide is added to the bath as a water soluble cyanide compound. Suitable water soluble alkali metal cyanide compounds for use in this invention include sodium, potassium and lithium cyanide. Among these, sodium and potassium cyanide are preferred, with potassium cyanide being most preferred.

The amount of the alkali metal cyanide compound to be added to the bath is critical. Too low a concentration results in spontaneous reduction of the gold ions, while too high a concentration results in the rapid deterioration of the plating rate. In general, the cyanide compound should be added in an amount ranging from about 0.01 to about 0.1, preferably about 0.01 to about 0.04, and most preferably about 0.025 to about 0.035, M.

The plating composition of this invention should be maintained at a pH within the range of about 10 to about 14, and preferably about 12 to about 14, in order to obtain the desired results It is therefore preferred that an alkali metal hydroxide, such as sodium or potassium hydroxide, and preferably potassium hydroxide be used to maintain the pH at this level The amount of alkali metal hydroxide added to the bath is generally about 0.25 to about 1.0, preferably about 0.78 to about 0.82, and most preferably about 0.800, M.

It is to be understood that the particular amount at which any of the ingredients should be added to the bath of this invention will depend on the amounts added of the other ingredients. Reaction (1) and the formula below for the constant "K" of Reaction (1) are used as guidelines for making selections of useful variants of the composition of the present invention.

$$K = \frac{[(CH_3)_2NH][BO_2^-]\,[CN^-]^6}{[(CH_3)_2NHBH_3]\,[OH^-]^4[Au\,(CN)_2^-]^3}$$

The criterion applied is that a change selected to be made in the concentration of one species must be compensated for in the other species such as to keep the value of K constant.

In addition, other substances such as, for example, lead, thiourea, arsenic, and the like, may be added in order to improve its properties. For example, lead is commonly added to electroless plating baths in the form of a lead salt to prevent the formation of metal particulates or "seeds" which continue to grow until the entire solution is depleted of the metal ions. Without the lead, any small particles which enter the bath, e.g., dust, will nucleate seeds. Lead, like cyanide, acts as a poison for the oxidation of the reducing agent. However, also like cyanide, lead stabilizes the bath against spontaneous decomposition.

Examples of suitable lead salts for use herein include lead acetate, lead citrate, lead maleate, lead phosphate, lead tartrate, lead sulfate, and mixtures thereof. Lead acetate is preferred. When lead is used, it is generally present in an amount ranging from about 1 to about 15, preferably about 3 to about 15, and most preferably about 5, ppm by weight.

The electroless plating bath of this invention may further contain an aliphatic amine. As disclosed in application Ser. No. 07/431,355, filed on Nov. 3, 1958 cited previously herein, aliphatic amines improve an autocatalytic plating bath's "throwing power", which denotes the ability of a bath to uniformly plate the entire surface of the substrate to be plated.

Examples of suitable aliphatic amines which may be used herein are disclosed in application Ser. No. 07/431,358 filed on Nov. 3, 1989.

The following table describes a preferred gold plating bath composition (1 liter) with optimal concentrations given providing the greatest stability (i.e., with respect to bath life and operating conditions):

TABLE I

| | |
|---|---|
| Potassium Gold Cyanide | 0.005M |
| Potassium Cyanide | 0.035M |
| Potassium Hydroxide | 0.800M |
| Potassium Carbonate | 0.750M |
| Lead Acetate | 5 ppm |
| Dimethylamine Borane | 0.050M |
| Hydrazine Hydrate | 0.250M |

The balance of the electroless plating bath of this invention is distilled water. The bath is normally used at a temperature of between about 70° C. and 100° C. Optimal operation will be at 80° C., at which temperature the rate of gold deposition is up to about 7 micrometers per hour.

To carry out the electroless gold plating on a given substrate, the substrate is immersed in the stirred plating solution for an exposure time providing the requisite gold deposit thickness. Thereafter, the substrate is removed from the bath and immediately rinsed with distilled water to remove any residual plating chemicals from the plated gold metal surfaces. Generally, the rinse water is quickly removed by blotting the substrate dry or by immersion of the substrate in sequence in a series of solvents.

In carrying out the gold plating of substrates on a continuing basis all components of the formulation selected should be added to the plating bath at regular intervals or continuously to replenish the bath. Preferably, the components being added are introduced in aqueous form such that they replenish the bath to within 20% or less of its original concentration. The plating solution volume is maintained by introducing distilled water to offset water lost by evaporation.

The present invention will be further understood from the description of specific examples which follow These examples are intended for illustrative purposes only and should not be construed as a limitation upon the broadest aspects of the invention.

Examples 1-6 illustrate the oxidation kinetics of dimethylamine borane (DMAB) and hydrazine on gold, copper, and nickel foil at 80° C. in plating solutions containing 0.800M KOH and 0.05M of the reducing agent. Table II sets forth the substrate and reducing agent used in each of the examples. The results are shown in FIG. 1.

TABLE II

| Example No. | Substrate | Reducing Agent |
|---|---|---|
| 1 | gold | hydrazine |
| 2 | copper | hydrazine |
| 3 | nickel | hydrazine |
| 4 | gold | DMAB |
| 5 | nickel | DMAB |
| 6 | copper | DMAB |

It can be seen from FIG. 1 that nickel is a good catalyst for both DMAB and hydrazine (Examples 3 and 5, respectively), which is the reason why both reducing agents are used in baths for plating nickel. Gold and copper are excellent catalysts for DMAB (Examples 4 and 6, respectively), but poor catalysts for hydrazine (Examples 1 and 2, respectively). This is the reason why many gold plating solutions use DMAB but almost no autocatalytic baths use hydrazine.

EXAMPLES 7-10

In the following examples, 0.035M cyanide was added to the compositions used in Examples 3-6 to illustrate how cyanide acts as a poison. Table III below indicates the reducing agents and substrates used in the various examples. The results are shown in FIG. 2.

TABLE III

| Example No. | Substrate | Reducing Agent |
|---|---|---|
| 7 | nickel | hydrazine |
| 8 | gold | DMAB |
| 9 | copper | DMAB |
| 10 | nickel | DMAB |

Figure 2:
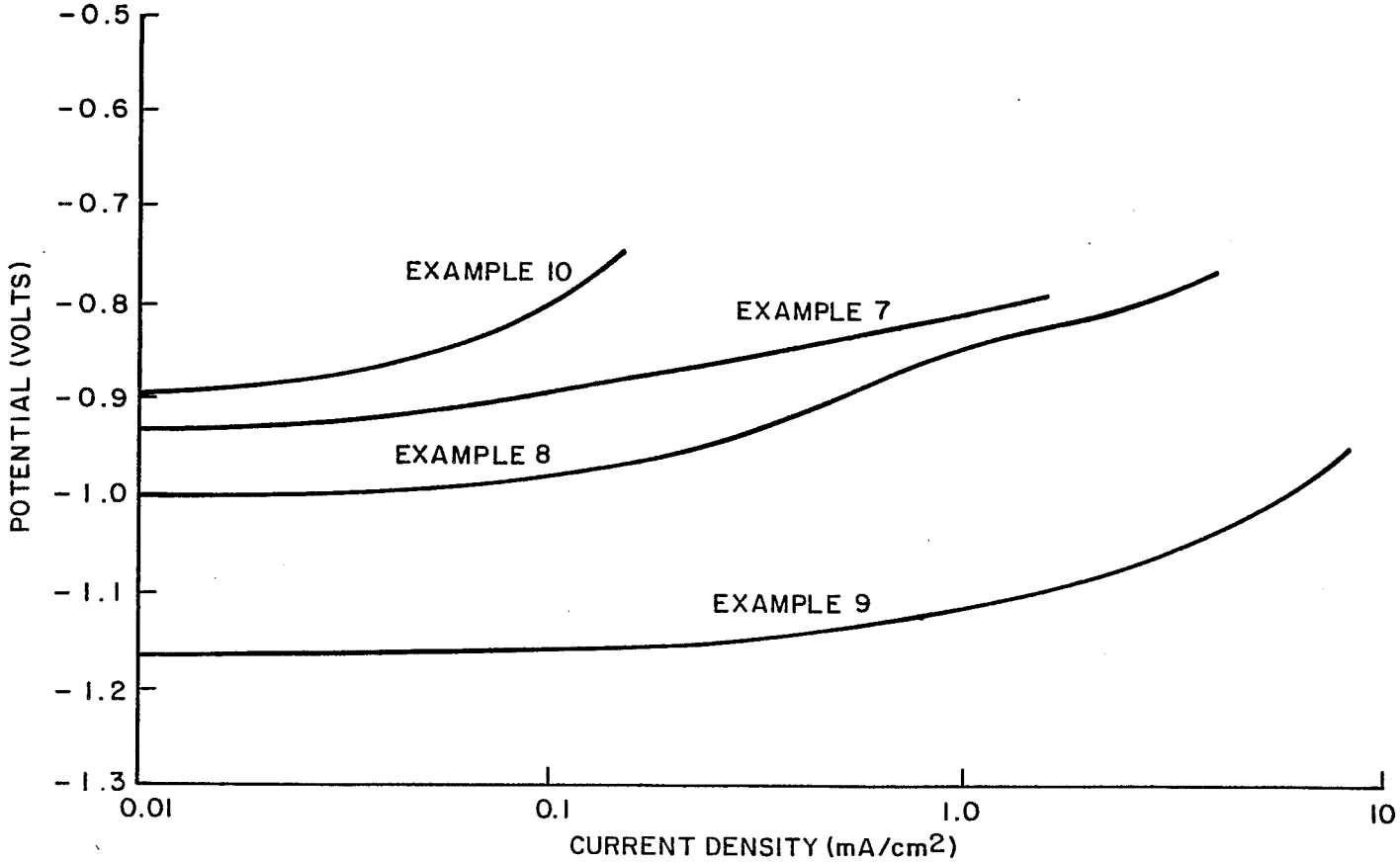
FIG. 2 is a schematic representation of the oxidation kinetics of the reducing agents dimethylamine borane and hydrazine on gold, nickel, and copper substrates at 80° C. in a solution of 0.800M KOH and 0.035M cyanide.

It can be seen from FIG. 2 that cyanide acts differently on each substrate and with each reducing agent. Copper remains an excellent catalyst for DMAB oxidation even in the presence of cyanide (Example 9). This is why plating rates are often reported on copper rather than on gold foils. However, once the copper substrate is covered with gold, the plating rate drops to that reflective of the oxidation rate on gold foil. The behavior of cyanide on gold foil is markedly different from that of cyanide on copper foil. DMAB oxidation is clearly poisoned on gold by cyanide (Example 8) but the decreased current at most potentials is still sufficient for reasonable plating rates. Hydrazine oxidation on gold is poisoned by cyanide to such an extent that no current is observed within minutes of the addition of the cyanide to the bath. This is why hydrazine can not be used in an autocatalytic gold plating bath. Hydrazine, however, can be used to plate gold onto nickel. FIG. 2 shows that while cyanide does poison the activity of hydrazine on nickel (Example 7), it does not have a significant effect. However, once the nickel is covered with gold, the reaction stops and no further gold plating occurs. Such a bath is not autocatalytic, therefore, since it will not plate gold on gold foil. DMAB, in contrast to hydrazine, is strongly poisoned by cyanide on a nickel substrate (Example 10). This is a major limitation of autocatalytic baths which use DMAB as the reducing agent since such baths do not plate well on nickel. When using such baths, the nickel must first be plated with an immersion gold so as to give the DMAB some gold on which to react.

EXAMPLE 11 AND COMPARATIVE EXAMPLE A

The following examples illustrate the effect of hydrazine on the plating of gold on nickel and gold foil. Example 11 used the plating solution set forth in Table IV below. The plating solution used in Comparative Example A contained the same ingredients as the plating solution shown in Table IV except for the hydrazine hydrate.

TABLE IV

| | |
|---|---|
| Potassium Gold Cyanide | 0.005M |
| Potassium Cyanide | 0.035M |
| Potassium Hydroxide | 0.800M |
| Potassium Carbonate | 0.450M |
| Lead Acetate | 15 ppm |
| Dimethylamine Borane | 0.050M |
| Hydrazine Hydrate | 0.250M |

Gold and nickel foil were placed in the solutions used in Comparative Example A and Example 11 and plated as follows. A 300 mL solution of the gold plating composition was prepared and heated to 80° C. on a stirrer hot plate in a 500 mL pyrex beaker. A gold foil and a nickel foil sample each having a surface area of 4 $cm^2$ were immersed for 10 minutes in the plating bath and weighed.

In the absence of hydrazine, i.e. Comparative Example A, gold foil plated at a rate of about 7.8 micrometers per hour while the nickel foil plated at about 0.9 micrometers per hour. The plating in the nickel was very nonuniform having areas with no gold deposited. In the presence of hydrazine, i.e., Example 11, the gold foil plated at the same rate, i.e., about 7.8 micrometers per hour but the nickel foil plated at about 2.6 micrometers per hour and was uniformly plated. After the nickel foil in Example 11 was covered with a sufficient amount of gold, the rate increased to that of the gold foil.

The plating bath set forth in Table I and Example 11 above has been operated for up to seven days at 80° C. without any digression of either reducing agent other than that digression which normally occurs during plating in the absence of the other reducing agent. The bath has been operated using a nickel level of 20 ppm by weight, a level at which current baths stop functioning.

While the present invention has been described with reference to particular embodiments thereof, it will be understood that numerous modifications may be made by those skilled in the art without actually departing from the spirit and scope of the invention as defined in the appended claims.

What is claimed is:

1. An aqueous autocatalytic electroless gold plating composition having a pH within the range of about 10 to about 14 and comprising about 0.002 to about 0.20M of a water-soluble alkali metal monovalent gold cyanide complex, about 0.01 to about 0.1M of a water-soluble alkali metal cyanide, about 0.1 to about 1.0M of a carbonate compound, about 0.01 to about 0.1M of a first reducing agent selected from the group consisting of water soluble alkali metal borohydrides and water soluble amine boranes, and about 0.01 to about 1.0M of a second reducing agent selected from the group consisting of hydrazine and hydrazine derivatives.

2. A gold composition according to claim 1 wherein the composition has a pH within the range of about 12 to about 14.

3. A gold plating composition according to claim 1 further comprising an alkali metal hydroxide in an amount sufficient to maintain the pH in the specified range.

4. A gold plating composition according to claim 1 wherein the composition comprises about 0.005 to about 0.0075M of the alkali metal monovalent gold cyanide complex, about 0.01 to about 0.04M of the alkali metal cyanide, about 0.6 to about 0.8M of the carbonate compound, about 0.04 to about 0.08M of the first reducing agent, about 0.2 to about 0.5M of the second reducing agent, and about 0.25 to about 1.0M of the alkali metal hydroxide.

5. A gold plating composition according to claim 1 wherein the composition comprises about 0.005 to about 0.006M of the alkali metal monovalent gold cyanide complex, about 0.025 to about 0.035M of the alkali metal cyanide, about 0.75 to about 0.80M of the carbonate compound, about 0.045 to about 0.055M of the first reducing agent, about 0.25 to about 0.35M of the second reducing agent, and about 0.78 to about 0.82M of the alkali metal hydroxide.

6. A gold plating composition according to claim 1 wherein the first reducing agent is a dialkylamine borane.

7. A gold plating composition according to claim 6 wherein the first reducing agent is dimethylamine borane.

8. A gold plating composition according to claim 1 wherein the second reducing agent is a hydrazine derivative.

9. A gold plating composition according to claim 8 wherein the hydrazine derivative is hydroxyethylhydrazine, hydrazine sulfate, hydrazine dihydrochloride, or hydrazine hydrate.

10. A gold plating composition according to claim 9 wherein the hydrazine derivative is hydrazine hydrate.

11. A gold plating composition according to claim 1 wherein the carbonate compound is an alkali metal carbonate.

12. A gold plating composition according to claim 11 wherein the carbonate is potassium carbonate.

13. A gold plating composition according to claim 1 wherein the water-soluble alkali metal monovalent gold cyanide complex is potassium gold cyanide.

14. A gold plating composition according to claim 1 wherein the alkali metal cyanide is potassium cyanide.

15. A gold plating composition according to claim 3 wherein the alkali metal hydroxide is potassium hydroxide.

16. A gold plating composition according to claim 1 further comprising about 1 to about 15 ppm of a lead salt.

17. A gold plating composition according to claim 16 wherein the lead salt is lead acetate.

18. A gold plating composition according to claim 17 further comprising about 0.1 to about 0.45M of an aliphatic amine.

19. An autocatalytic electroless aqueous gold plating composition comprising about 0.005M of potassium gold cyanide, about 0.035M of potassium cyanide, 0.750M of potassium carbonate, about 0.050M of dimethylamine borane, about 0.250M of hydrazine hydrate, about 0.800M of potassium hydroxide, and about 5 ppm by weight of lead acetate.

* * * * *